US005679019A

United States Patent [19]

Sakai et al.

[11] Patent Number: 5,679,019

[45] Date of Patent: Oct. 21, 1997

[54] WATERPROOF TAP COVER FOR WATERPROOF CONNECTOR

[75] Inventors: Hitoshi Sakai; Hitoshi Saito; Toshinori Yamamoto, all of Shizuoka, Japan

[73] Assignee: Yazaki Corporation, Tokyo, Japan

[21] Appl. No.: 393,481

[22] Filed: Feb. 24, 1995

[30] Foreign Application Priority Data

Feb. 25, 1994 [JP] Japan ..... 6-028040

[51] Int. Cl.[6] ..... H01R 13/52

[52] U.S. Cl. ..... 439/275; 439/271

[58] Field of Search ..... 439/271, 272, 439/273, 274, 275, 587

[56] References Cited

U.S. PATENT DOCUMENTS

| | | | |
|---|---|---|---|
| 4,614,390 | 9/1986 | Baker | 439/275 |
| 4,643,506 | 2/1987 | Kobler | 439/271 |
| 4,648,672 | 3/1987 | Kobler | 439/271 |
| 4,713,021 | 12/1987 | Kobler | 439/275 |
| 5,100,335 | 3/1992 | Yamamoto | 439/271 |
| 5,266,045 | 11/1993 | Yamamoto et al. | 439/275 |

FOREIGN PATENT DOCUMENTS

| | | | |
|---|---|---|---|
| 3-122979 | 5/1991 | Japan | H01R 13/42 |

*Primary Examiner*—David L. Pirlot
*Assistant Examiner*—Tho Dac Ta
*Attorney, Agent, or Firm*—Sughrue, Mion, Zinn, Macpeak, and Seas

[57] ABSTRACT

A waterproof tap cover for use in a waterproof connector which prevents a waterproof tap from being damaged when a terminal metal member is removed from a connector housing in the waterproof connector. The waterproof tap, which is formed of rubber and includes a plurality of insertion holes respectively formed so as to oppose a plurality of terminal storage chambers formed in the connector housing, is fitted with the rear portion of the connector housing, and the waterproof tap is fixed by the waterproof tap cover which has a plurality of through holes corresponding to the insertion holes. Chamfered escape recesses are formed in the hole edge portions of the through holes adjacent the waterproof tap in order to accommodate ridge portions of the waterproof tap when the terminals are withdrawn from the connector housing so that the connector can be resealed when the terminals are inserted again.

12 Claims, 3 Drawing Sheets

WATERPROOF TAP COVER FOR WATERPROOF CONNECTOR

BACKGROUND OF THE INVENTION

1. Field of the Invention

The present invention relates to a waterproof tap cover for a waterproof connector which is employed for connection of a wire harness for an automobile or the like.

2. Description of the Background Art

FIG. 5 shows a section view of a conventional waterproof connector which is disclosed in Japanese Patent Publication No. 3-122979 of Heisei. In this conventional waterproof connector, a waterproof packing b formed of rubber is fitted with the outer peripheral portion of a waterproof male connector housing a, and a waterproof tap d formed of rubber is fitted with an open chamber c formed in the rear portion of the connector housing a, while the waterproof tap d is fixed by a waterproof tap cover e which is formed of synthetic resin and is secured to the connector housing a.

The waterproof tap d includes insertion holes g each having sealing annular ribs $g_1$ which are respectively formed so as to correspond to terminal storage chambers f formed in the connector housing a, while the waterproof tap cover e, includes through holes h which are respectively formed so as to correspond to the insertion holes g and have a larger diameter than the insertion holes g.

In this state, terminal metal members j previously connected with electric wires i are respectively passed from the insertion holes h through the insertion holes g while deforming the annular ribs $g_1$ and are then secured at given positions of the respective terminal chambers f by flexible securing pieces k. After the terminal metal members k are inserted past the annular ribs $g_1$, the annular ribs $g_1$ are restored to their respective original states and the restored annular ribs $g_1$ come into pressure contact with the outer peripheral surfaces of the respective electric wires i to create a seal.

In the above-mentioned structure, when the terminal metal member j is removed from the connector housing a because it is damaged or for some other reason, the annular rib $g_1$ of the waterproof tap d is taken out together with the terminal metal member j and, especially, the portion of the annular rib $g_1$ in contact with the upper portion of a female electric contact person $j_1$ can be caught between the waterproof tap cover e and the upper portion of the female electric contact portion $j_1$ and thus can be torn into pieces $g_1$, (see FIG. 6). If the terminal metal member j is inserted again in this condition, then a gap l is produced between the electric wire i and the insertion hole g of the waterproof tap d, which makes it impossible for the waterproof connector to remain watertight (see FIG. 7).

SUMMARY OF THE INVENTION

The present invention is intended to eliminate the drawbacks found in the above-mentioned conventional waterproof connector. Accordingly, it is an object of the invention to provide a waterproof connector including a waterproof tap cover, which can prevent a waterproof tap from being damaged when a terminal metal member is removed from a connector housing thereof.

In attaining the above object, according to the invention there Is employed a structure in which a waterproof tap formed of rubber and including a plurality of insertion holes respectively arranged opposed to a plurality of terminal storage chambers respectively formed in a connector housing is fitted with the rear portion of the connector housing, the waterproof tap is fixed by a waterproof tap cover including a plurality of through holes respectively formed so as to correspond to the insertion holes of the waterproof tap, end a plurality of chamfered escape recesses are formed in respective edge portions of the through holes adjacent the surface of the waterproof tap.

According to the structure of the invention, when the terminal metal member is removed from the corrector housing, the deformed portion of the waterproof tap is moved into the chamfered escape recess of the waterproof tap cover rather than being separated from the waterproof tap to prevent resealing when the terminal members are reinserted.

DETAILED DESCRIPTION OF THE PREFERRED EMBODIMENTS OF THE INVENTION

A detailed description is given below of the preferred embodiments of a waterproof tap cover for use in a waterproof connector according to the invention with reference to the accompanying drawings.

Figure 1:
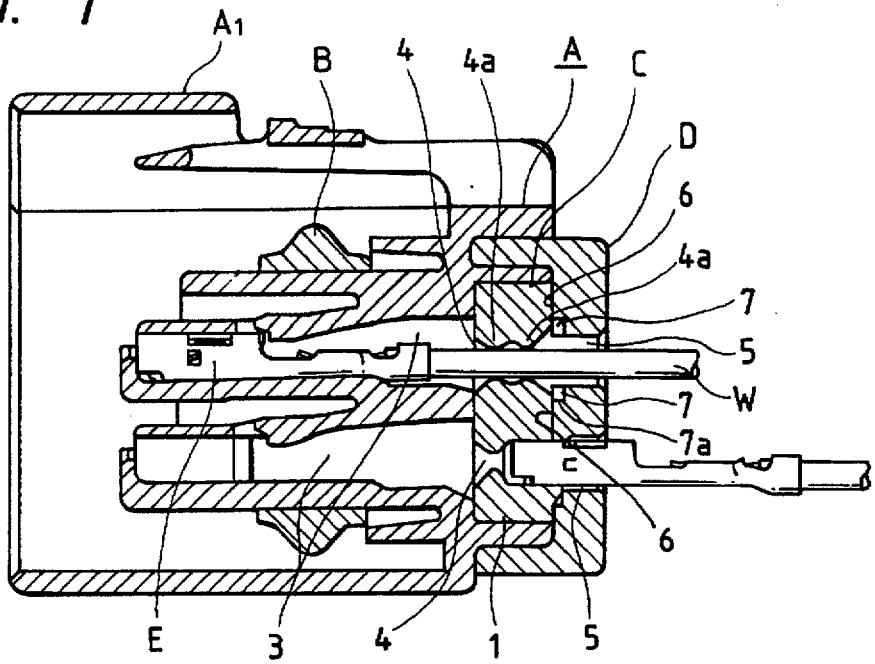
FIG. 1 is a sectional view of a first embodiment of a waterproof tap cover for use in a waterproof connector according to the invention.
Figure 2:
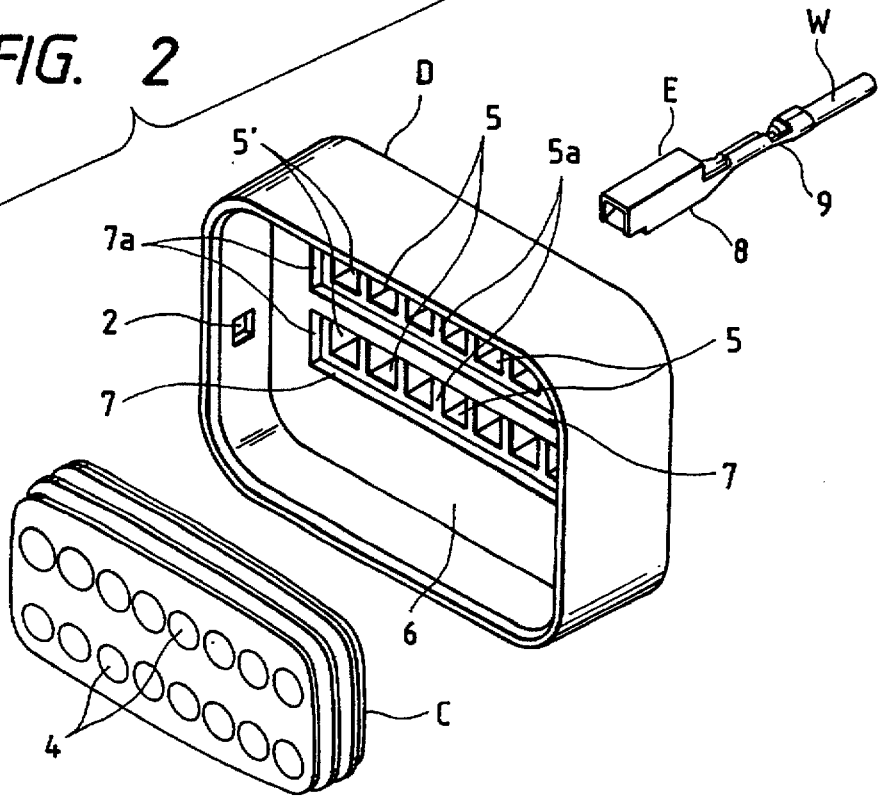
FIG. 2 is an exploded perspective view of a waterproof tap, a waterproof tap cover, and a terminal metal member employed in the first embodiment.
Figure 3:
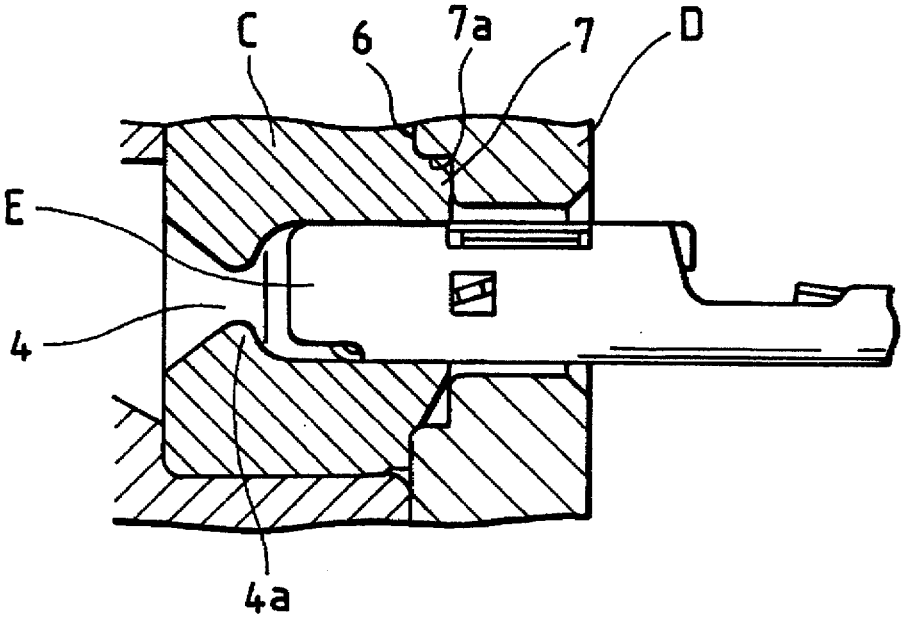
FIG. 3 is un enlarged sectional view of the operation state of the waterproof tap when the terminal metal member is removed from the connector housing of the present waterproof connector.

FIG. 1 is a sectional view of a first embodiment of a waterproof tap cover for use in a waterproof connector according to the invention. In FIG. 1, the waterproof connector comprises a male connector housing A which is formed of synthetic resin and includes a bushing portion $A_1$ for receiving a mating female connector housing. An annular waterproof packing B formed of rubber is fitted with the outer peripheral portion of the male connector housing A and a waterproof tap C formed of rubber is fitted into an open chamber 1 formed in the rear poetics of the male connector housing A, while the waterproof tap C is fixed by a waterproof tap cover D of synthetic resin to be secured to the connector housing A. Forwardly and internally of the peripheral wall portion of the waterproof tap cover D; there is formed a securing recessed portion 2 which engageable with a securing projection (not shown) provided in the outer surface of the connector housing A (see FIGS. 2 and 3).

In the waterproof tap C which is formed as a substantially flat plate, there are a plurality of circular insertion holes 4 which respectively correspond to a plurality of terminal storage chambers 3 formed in the connector housing A and which also respectively include annular ribs 4*a* (see FIG. 1) for forming a seal around the wire W. In a waterproof tap cover D, there are a plurality of square-shaped through holes 5 which respectively correspond to the insertion holes 4 and are larger than the insertion holes 4. The through holes 5 are arranged successively and transversely in two rows, while partition walls 5*a* between the adjacent through holes 5 are spaced from the waterproof tap hold surface 6 of the waterproof tap cover D. Also, in the respective hole edges of the through holes 5, there are annular chamfered escape recesses 7 which extend rearwardly from the waterproof tap hold surface 6 and include a stepped portion 7*a*. For the through holes 5' that are situated at the two extreme ends of the transversely and successively arranged through holes 5, the chamfered escape recesses 7 are formed on the upper and lower portions thereof as well as on one side thereof, while, for the remaining through holes situated in the intermediate positions, the chamfered escape recesses 7 are formed only in the upper and lower portions thereof.

The terminal metal member E includes a female type electric contact portion 8 and an electric connection portion 9, while an electric wire W is previously connected to the electric connection 9.

Figure 6:
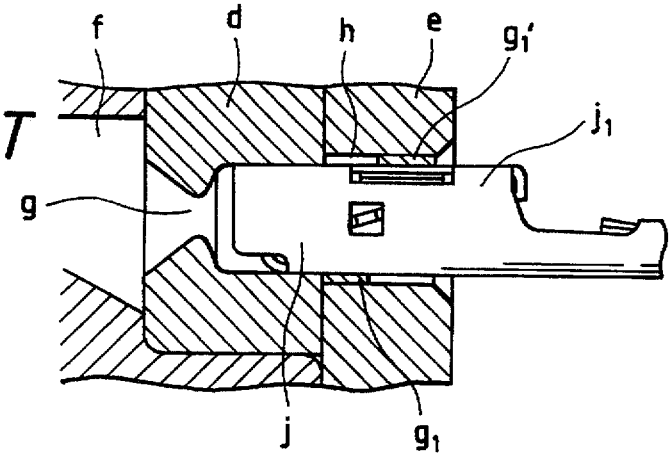
FIG. 6 PRIOR ART
FIG. 6 is an enlarged sectional view of the operation state of a waterproof tap when a terminal metal member is removed from the connector housing of the above-mentioned conventional waterproof connector.
Figure 7:
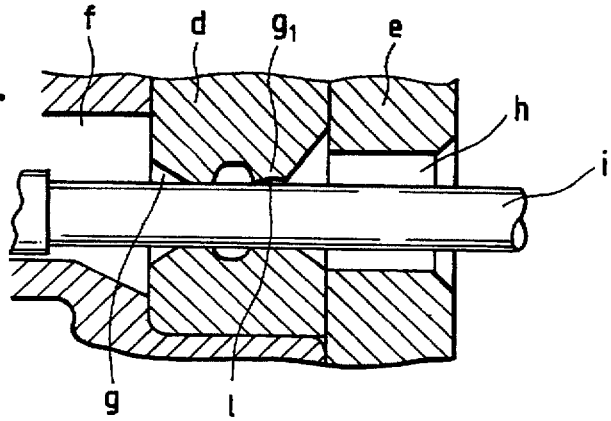
FIG. 7 PRIOR ART
FIG. 7 is a sectional view of the above conventional waterproof tap when it is used again.

In the above-mentioned structure, if the terminal metal member E is removed from the state shown in FIG. 1, then the rib 4*a* portion of the circular insertion hole 4, which is pulled following the removal of the terminal metal member E, is allowed to escape into the chamfered escape recess 7 of the waterproof tap cover D (see FIG. 3), and thus the rib 4*a* portion is never caught between the terminal metal member E and through hole 5, thereby preventing the waterproof tap from being torn into pieces as occurs in the conventional waterproof taps (see FIG. 6).

Figure 4:
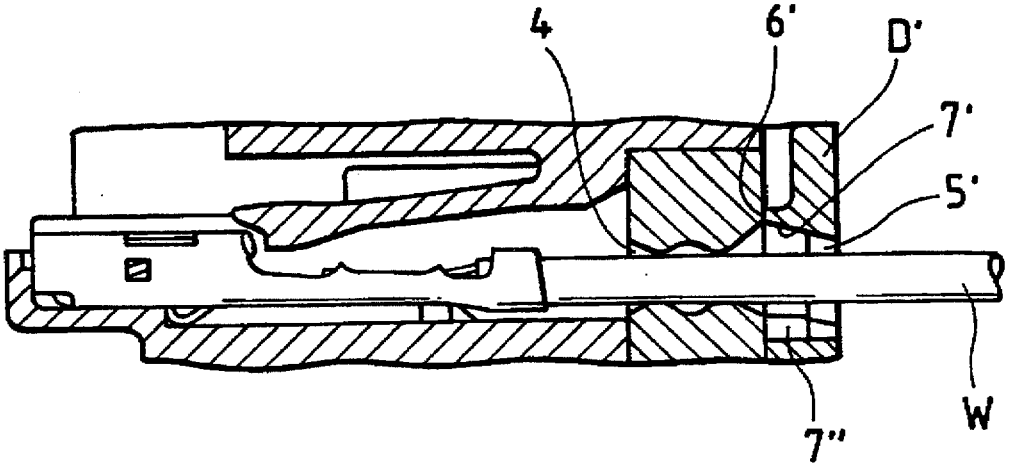
FIG. 4 is a sectional view of the main portions of a second embodiment of a waterproof tap cover for use in a waterproof connector according to the invention.
Figure 5:
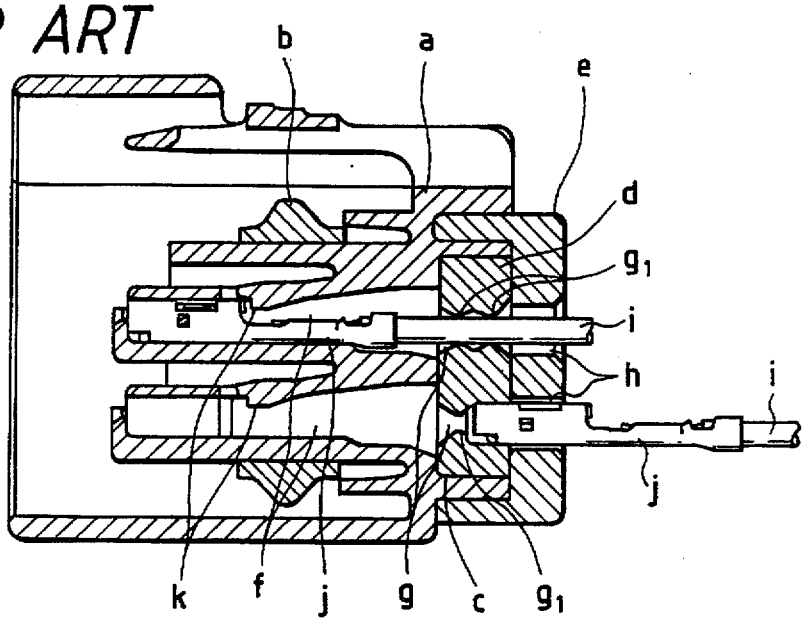
FIG. 5 PRIOR ART
FIG. 5 is a sectional view of a waterproof tap cover employed in a conventional waterproof connector.

In the second embodiment of the invention shown in FIG. 4, a square-shaped through hole 5' formed in a waterproof tap cover D' includes in the upper hole edge thereof a tapered, chamfered escape recess 7' formed so as to extend from the waterproof tap hold surface 6', while a groove portion 7" is formed in the lower central portion of the through hole 5'.

As has been described above, according to the invention, due to the fact that chamfered escape recesses are formed in respective hole edges of the through bores in the waterproof cover, there is no possibility that, when the terminal metal member is removed, the waterproof tap can be pulled between the terminal metal member and the waterproof tap cover and be torn into pieces.

What is claimed is:

1. A waterproof tap cover for use in a waterproof connector, the waterproof connector comprising a connector housing having a plurality of terminal storage chambers and a resilient waterproof tap held in position by said waterproof tap cover, the waterproof tap having a plurality of insertion holes formed so as to oppose the plurality of terminal storage chambers formed in the connector housing when the waterproof tap is mated with a rear portion of the connector housing, said waterproof tap cover comprising a plurality of through holes formed so as to correspond to the plurality of insertion holes, wherein escape recesses are individually formed in edge portions of each of the plurality of through holes of said waterproof tap cover and waterproof tap retaining surfaces are provided between adjacent through holes, said waterproof tap retaining surfaces abutting against said waterproof tap.

2. A waterproof tap cover as recited in claim 1, wherein the escape recesses are chamfered.

3. A waterproof tap cover as recited in claim 1, wherein the escape recesses comprise a stepped portion in a surface of the waterproof tap cover that is mated with the waterproof tap.

4. A waterproof tap cover as recited in claim 1, wherein the escape recesses comprise an annular stepped portion surrounding the plurality of through holes in the waterproof tap cover.

5. A waterproof tap cover as recited in claim 4, wherein the annular stepped portion is chamfered.

6. A waterproof tap cover as recited in claim 1, wherein one or more of the plurality of through holes are separated by partition walls, and wherein a gap is formed between the partition walls and a surface of the waterproof tap when the waterproof tap and the waterproof tap cover are mated, the escape recesses comprising a stepped portion in a surface of the waterproof tap cover that is mated with the surface of the waterproof tap, the stepped portion surrounding the plurality of through holes.

7. A waterproof tap cover as recited in claim 6, wherein the stepped portion is chamfered.

8. A waterproof tap cover as recited in claim 1, wherein the escape recesses comprise a tapered recess on one edge of each of the plurality of through holes, and wherein a groove is formed on another edge of each of the plurality of through holes.

9. A waterproof tap cover as recited in claim 8, wherein the escape recesses are chamfered.

10. A waterproof tap cover as recited in claim 8, wherein the tapered recess opens toward a surface of the waterproof tap.

11. A waterproof tap cover as recited in claim 8, wherein the tapered recess and the groove are formed in opposing edges of each of the plurality of through holes.

12. A waterproof tap cover as recited in claim 8, wherein the tapered recess surrounds the plurality of through holes in the waterproof tap cover.

* * * * *